US011073782B2

(12) United States Patent
Hamatsu

(10) Patent No.: US 11,073,782 B2
(45) Date of Patent: Jul. 27, 2021

(54) IMAGE FORMING APPARATUS INCLUDING A DETECTION UNIT CONFIGURED TO DETECT A DENSITY OF A REFERENCE TONER IMAGE

(71) Applicant: FUJIFILM Business Innovation Corp., Tokyo (JP)

(72) Inventor: Makoto Hamatsu, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/831,083

(22) Filed: Mar. 26, 2020

(65) Prior Publication Data

US 2021/0080887 A1 Mar. 18, 2021

(30) Foreign Application Priority Data

Sep. 17, 2019 (JP) ..... JP2019-167909

(51) Int. Cl.
*G03G 15/00* (2006.01)

(52) U.S. Cl.
CPC ..... *G03G 15/5041* (2013.01); *G03G 15/5058* (2013.01); *G03G 2215/00042* (2013.01); *G03G 2215/00059* (2013.01); *G03G 2215/00063* (2013.01)

(58) Field of Classification Search
CPC ..... G03G 15/5041; G03G 15/5058; G03G 2215/00042; G03G 2215/00059; G03G 2215/00063
See application file for complete search history.

(56) References Cited

U.S. PATENT DOCUMENTS

2008/0056752 A1* 3/2008 Denton ..... G03G 15/5062 399/74
2008/0138094 A1* 6/2008 Shiori ..... G03G 15/065 399/9
2010/0054774 A1* 3/2010 Yamasaki ..... G03G 15/0131 399/49
2012/0226466 A1* 9/2012 Henderson ..... G03G 15/5058 702/137

FOREIGN PATENT DOCUMENTS

JP 2005-189704 A 7/2005

* cited by examiner

*Primary Examiner* — Sandra Brase
(74) *Attorney, Agent, or Firm* — Sughrue Mion, PLLC

(57) ABSTRACT

An image forming apparatus includes a detection unit that optically detects a density of a reference toner image for density measurement formed on an image carrier. Either a first detection method for detecting the density of the reference toner image by receiving specularly reflected light reflected by the image carrier and the reference toner image for density measurement formed on the image carrier or a second detection method for detecting the density of the reference toner image by receiving diffusely reflected light from the image carrier and the reference toner image, is selected in accordance with color information of a toner, the color information being stored beforehand in a storage unit, and the density of the reference toner image is optically detected.

23 Claims, 11 Drawing Sheets

IMAGE FORMING APPARATUS INCLUDING A DETECTION UNIT CONFIGURED TO DETECT A DENSITY OF A REFERENCE TONER IMAGE

CROSS-REFERENCE TO RELATED APPLICATIONS

This application is based on and claims priority under 35 USC 119 from Japanese Patent Application No. 2019-167909 filed Sep. 17, 2019.

BACKGROUND

(i) Technical Field

The present disclosure relates to an image forming apparatus.

(ii) Related Art

There is known an image forming apparatus that includes an image carrier on which electrostatic latent images are formed, a plurality of developing units each of which develops an electrostatic latent image with a developer containing a toner so as to form a toner image on the image carrier, a transfer unit that transfers a toner image formed on the image carrier onto a recording material, and a density detection unit that detects the image density of a toner image (Japanese Unexamined Patent Application Publication No. 2005-189704). The image forming apparatus controls image forming conditions on the basis of results of detection of the image densities of toner images performed by the density detection unit. The plurality of developing units include a developing unit containing a toner that has the same hue as a toner contained in another one of the plurality of developing units and that has a different concentration from the toner contained in the other developing unit, and the density detection unit includes a regularly-reflected-light detection unit that detects the amount of regularly reflected light with respect to irradiation light that is radiated onto a toner image and an irregularly-reflected-light detection unit that detects the amount of irregularly reflected light.

SUMMARY

Aspects of non-limiting embodiments of the present disclosure relate to controlling the amount of a toner to a predetermined amount regardless of the type of the toner and the position at which an image forming engine is disposed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a detection unit that optically detects a density of a reference toner image for density measurement formed on an image carrier. Either a first detection method for detecting the density of the reference toner image by receiving specularly reflected light reflected by the image carrier and the reference toner image for density measurement formed on the image carrier or a second detection method for detecting the density of the reference toner image by receiving diffusely reflected light from the image carrier and the reference toner image, is selected in accordance with color information of a toner, the color information being stored beforehand in a storage unit, and the density of the reference toner image is optically detected.

BRIEF DESCRIPTION OF THE DRAWINGS

An exemplary embodiment of the present disclosure will be described in detail based on the following figures, wherein.

DETAILED DESCRIPTION

Figure 1:
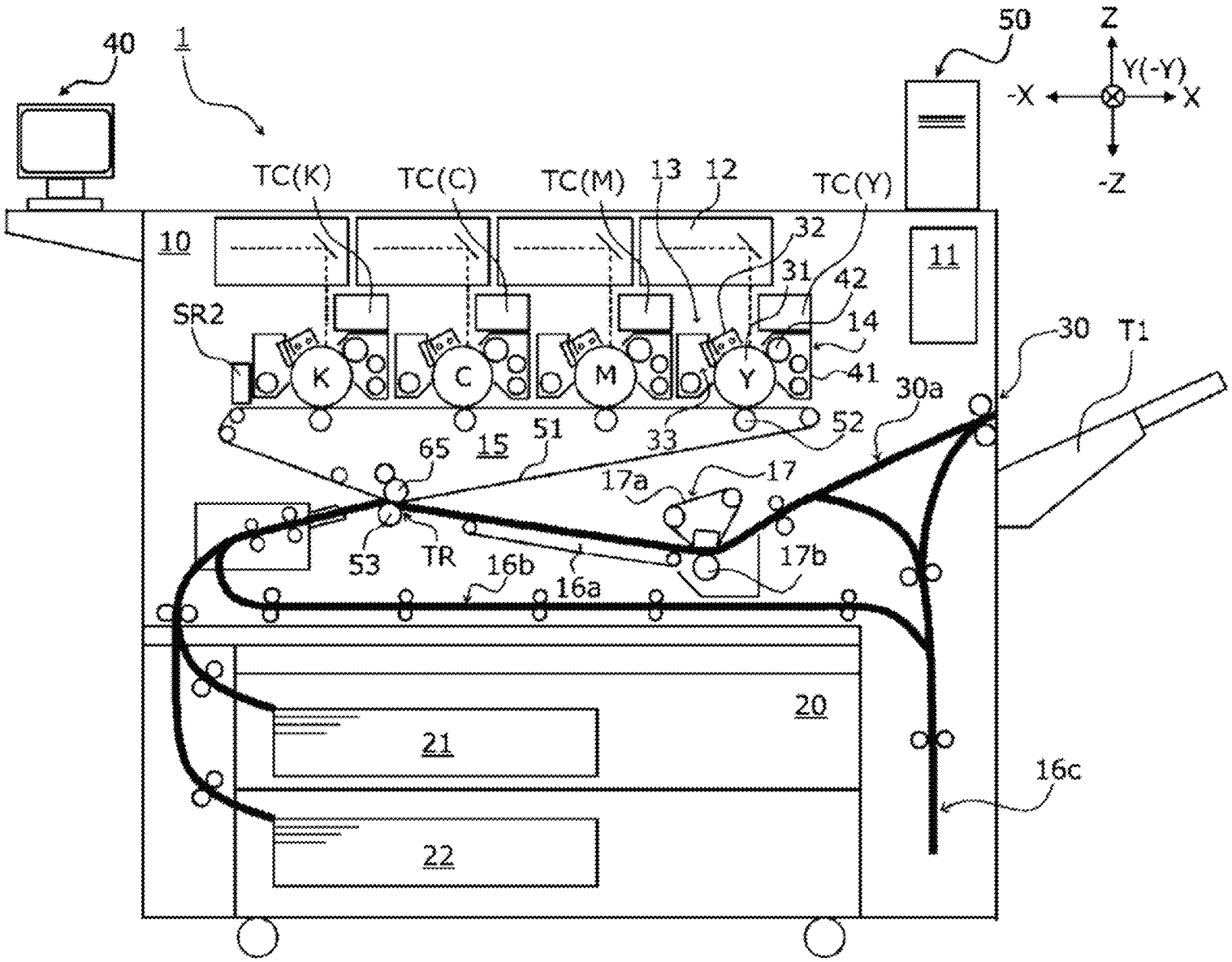
FIG. 1 is a schematic sectional view illustrating an internal configuration of an image forming apparatus.

Although an exemplary embodiment of the present disclosure will now be described in detail below using a specific example and with reference to the drawings, the present disclosure is not limited to the following exemplary embodiment and specific example.

In addition, in the drawings that will be referred to in the following description, objects are schematically illustrated, and it should be noted that dimensional ratios and so forth of the objects that are illustrated in the drawings are different from those of actual objects. Furthermore, for ease of understanding, illustration of components that are not necessary for the following description is suitably omitted in the drawings.

Figure 2:
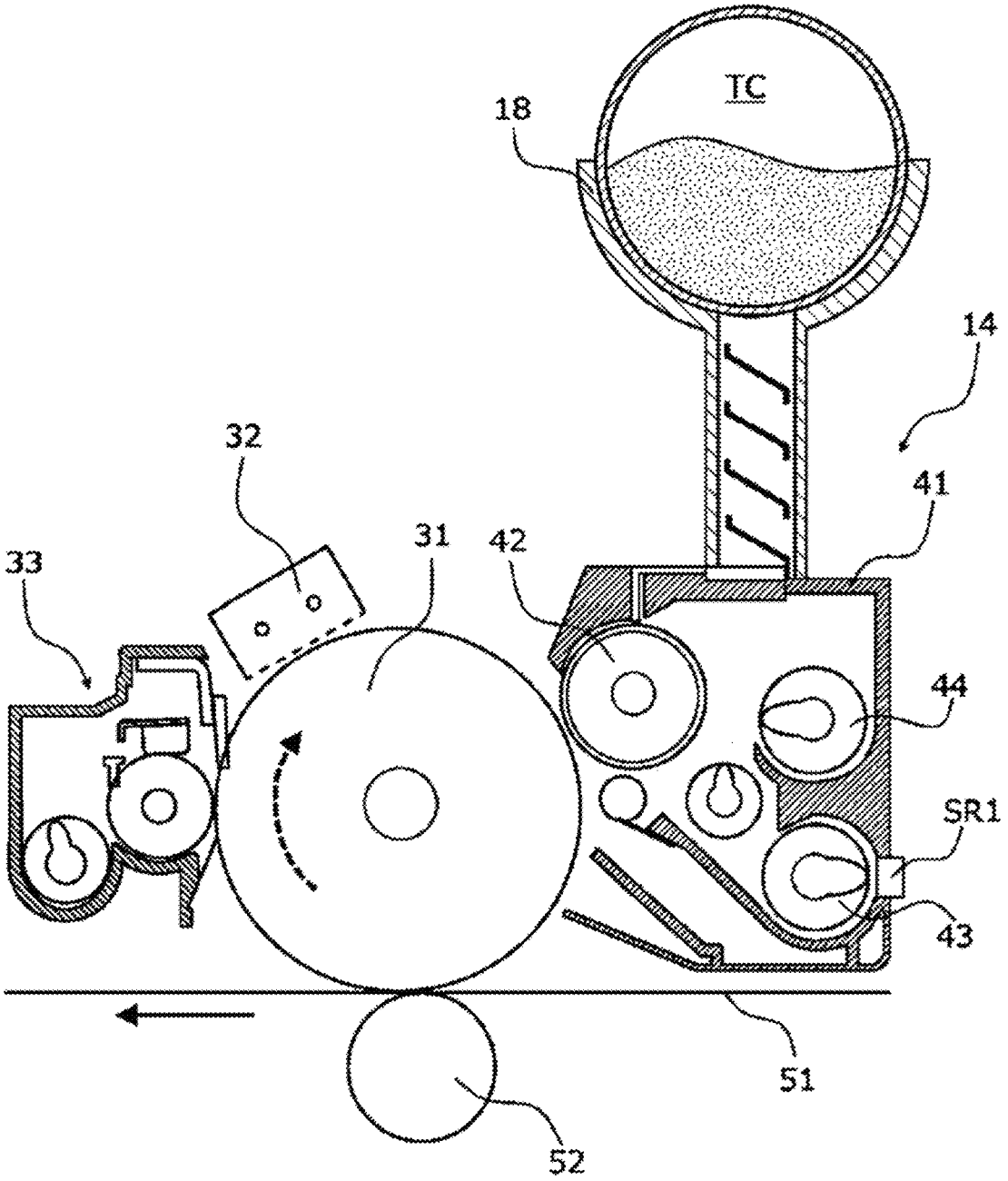
FIG. 2 is a schematic sectional view illustrating a photoconductor unit, a developing device, and a toner supply device.

(1) Overall Configuration and Operation of Image Forming Apparatus (1.1) Overall Configuration of Image Forming Apparatus FIG. 1 is a sectional view illustrating a schematic configuration an image forming apparatus 1 according to the present exemplary embodiment, and FIG. 2 is a schematic sectional view illustrating one of photoconductor units 13, one of developing devices 14, and one of toner supply devices 18.

The image forming apparatus 1 includes an image forming section 10, a sheet feeding device 20 that is installed below the image forming section 10, a sheet ejection unit 30 that is disposed at an end of the image forming section 10 and to which a printed sheet is to be ejected, an operation information unit 40, and an image processing unit 50 that generates image information from print information transmitted from a host device.

The image forming section 10 includes a system control device 11, exposure devices 12, the photoconductor units 13, the developing devices 14, a transfer device 15, sheet transport devices 16*a* and 16*b*, a fixing device 17, and the toner supply devices 18 (see FIG. 2) and forms a toner image onto a recording medium that is sent from the sheet feeding device 20.

The sheet feeding device 20 feeds a recording medium to the image forming section 10. In other words, the sheet feeding device 20 includes a plurality of sheet stacking units 21 and 22 in which recording media having different properties (e.g., material, thickness, sheet size, and grain) are accommodated and is configured to feed one of the recording media that is sent out from one of the plurality of sheet stacking units 21 and 22 to the image forming section 10.

The sheet ejection unit 30 ejects a sheet to which an image has been output by the image forming section 10 and to which the image has been fixed by the fixing device 17. Accordingly, the sheet ejection unit 30 includes a transport path 30*a* along which a sheet to which the image has been fixed is transported and an ejected-sheet accommodating unit T1 to which the sheet is ejected. The sheet ejection unit 30 further includes a sheet inversion unit 16*c* that inverts the front and rear surfaces of a sheet and sends out the sheet to the sheet transport device 16*b* in the case of performing image output on the two surfaces of the sheet. Note that the sheet ejection unit 30 may have a function of performing post-processing, such as cutting or stapling, on a stack of sheets output by the image forming section 10.

The operation information unit 40 is used for performing various settings, inputting instructions, and displaying information. In other words, the operation information unit 40 corresponds to a so-called user interface, and more specifically, the operation information unit 40 is formed by combining a liquid crystal display panel, various operation buttons, a touch panel, and so forth.

(1.2) Configuration and Operation of Image Forming Section

In the image forming apparatus 1 having the above-described configuration, a recording medium sent out from one of the sheet stacking units 21 and 22 of the sheet feeding device 20 that is specified by a print job for each print is sent into the image forming section 10 in accordance with the timing at which image formation is performed.

The photoconductor units 13 are arranged side by side below the exposure devices 12 and include photoconductor drums 31 each serving as a latent image carrier that is driven so as to rotate. Chargers 32, the exposure devices 12, the developing devices 14, first transfer rollers 52, and cleaning devices 33 are arranged in the direction of rotation of the corresponding photoconductor drums 31.

The photoconductor drum 31, the charger 32, and the cleaning device 33 of each of the photoconductor units 13 are integrated together into a cartridge, so that each of the cartridges is independently detachable from a body of the image forming apparatus 1 and is also independently attachable to the body of the image forming apparatus 1.

Each of the developing devices 14 includes a developing housing 41 that accommodates a developer containing a toner and a carrier, a developing roller 42 that is disposed so as to face the photoconductor drum 31, a stirring auger 43 that transports the developer while stirring the developer, and a supply auger 44 that supplies the developer to the developing roller 42. The configurations of the developing devices 14 are substantially similar to one another, except with regard to the developers, and the developing devices 14 form toner images onto the photoconductor drums 31 by using the developing rollers 42, the colors of the toner images including spot colors such as gold and silver each of which contains a photoluminescent pigment, white that contains a metallic pigment, and a clear color as well as general colors that are yellow (Y), magenta (M), cyan (C), and black (K).

Each of the developing devices 14 is provided with an auto toner control (ATC) sensor SR1 that measures the ratio of the toner to the carrier in the developer that circulates in the developing housing 41 (hereinafter sometimes referred to as toner concentration (TC)).

One of toner cartridges TC and one of the toner supply devices 18 (see FIG. 2) are arranged above each of the developing devices 14. Each of the toner cartridges TC contains the corresponding toner and is replaceable, and each of the toner supply devices 18 supplies the toner and the carrier from the corresponding toner cartridge TC to the corresponding developing device 14. Each of the toner cartridges TC is provided with an integrated circuit (IC) tag 140, which is an example of a storage unit (not illustrated in FIG. 1, see FIG. 9 and FIG. 10), and for example, identification information including color information of the corresponding toner and usage history information are stored in the IC tag 140.

Each of the developing devices 14 may form an image forming engine for the corresponding color together with the corresponding toner cartridge TC and the corresponding toner supply device 18, and the image forming engines are interchangeable with respect to the photoconductor units 13. In addition, the photoconductor units 13 may be used interchangeably.

The surfaces of the photoconductor drums 31, which rotate, are charged by the chargers 32, and electrostatic latent images are formed on the surfaces of the photoconductor drums 31 by latent image-forming light beams emitted from the exposure devices 12. The electrostatic latent images formed on the photoconductor drums 31 are developed into toner images by the developing rollers 42.

The transfer device 15 includes an intermediate transfer belt 51, the first transfer rollers 52, and a second transfer roller 53. The intermediate transfer belt 51 is an example of an image carrier onto which toner images of different colors formed on the photoconductor drums 31 of the photoconductor units 13 are transferred such that the toner images are superposed with one another. The first transfer rollers 52 sequentially transfer (in a first transfer process) the toner images of the different colors, which are formed by the photoconductor units 13, onto the intermediate transfer belt 51. The second transfer roller 53 collectively transfers (in a second transfer process) the toner images of the different colors, which have been transferred to the intermediate transfer belt 51 in such a manner as to be superposed with one another, onto a sheet that is a recording medium.

An auto density control (ADC) sensor SR2 is disposed at a position downstream from the image forming engine that corresponds to black (K) and upstream from a second transfer region TR so as to face the intermediate transfer belt 51. The ADC sensor SR2 is an example of a detection unit that detects the density of a reference toner image for density measurement that has been transferred to the intermediate transfer belt 51.

Toner images of different colors formed on the photoconductor drums 31 of the photoconductor units 13 are sequentially and electrostatically transferred (in the first transfer process) onto the intermediate transfer belt 51 by the first transfer rollers 52 to each of which a predetermined transfer voltage has been applied from a power supply device or the like (not illustrated), which is controlled by the system control device 11, and as a result, a superposed toner image, which is formed of the toner images of the different colors superposed with one another, is formed.

The superposed toner image on the intermediate transfer belt 51 is transported to the second transfer region TR along with movement of the intermediate transfer belt 51. In the second transfer region TR, the second transfer roller 53 is disposed so as to be press-contacted against a backup roller 65 with the intermediate transfer belt 51 interposed therebetween. A sheet is supplied from the sheet feeding device 20 to the second transfer region TR in accordance with the timing at which the superposed toner image is transported to the second transfer region TR. Then, a predetermined second transfer voltage is applied to the backup roller 65, which faces the second transfer roller 53 with the intermediate transfer belt 51 interposed therebetween, from the power supply device or the like (not illustrated) controlled by the system control device 11, and the superposed toner image on the intermediate transfer belt 51 is transferred onto the sheet.

Toner remaining on the surface of each of the photoconductor drums 31 is removed by the corresponding cleaning device 33 and collected and placed into a waste-toner container (not illustrated). The surfaces of the photoconductor drums 31 are charged again by the chargers 32.

The fixing device 17 includes an endless fixing belt 17*a* that rotates in one direction and a pressure roller 17*b* that is in contact with the outer surface of the fixing belt 17*a* and that rotates in one direction. A region in which the fixing belt 17*a* and the pressure roller 17*b* are pressed into contact with each other forms a nip part (a fixing region).

The sheet to which the superposed toner image has been transferred by the transfer device 15 is transported to the fixing device 17 via the sheet transport device 16*a* in a state where the superposed toner image is unfixed to the sheet. The superposed toner image is fixed onto the sheet, which is transported to the fixing device 17, as a result of heat and pressure being applied to the sheet by the fixing belt 17*a* and the pressure roller 17*b* that are paired with each other.

Sheets to each of which a superposed toner image has been fixed are stacked on the ejected-sheet accommodating unit T1. Note that, in the case of performing image output on the two surfaces of a sheet, the sheet is flipped over by the sheet inversion unit 16*c*, and the sheet is sent again into the second transfer region TR in the image forming section 10 via the sheet transport device 16*b*. After the superposed toner image has been transferred to the sheet, and the transferred superposed toner image has been fixed to the sheet, the sheet is sent to the sheet ejection unit 30. The sheets sent to the sheet ejection unit 30 undergo post-processing, such as cutting or stapling, as necessary.

(2) Detection of Density of Reference Toner Image

Figure 3:
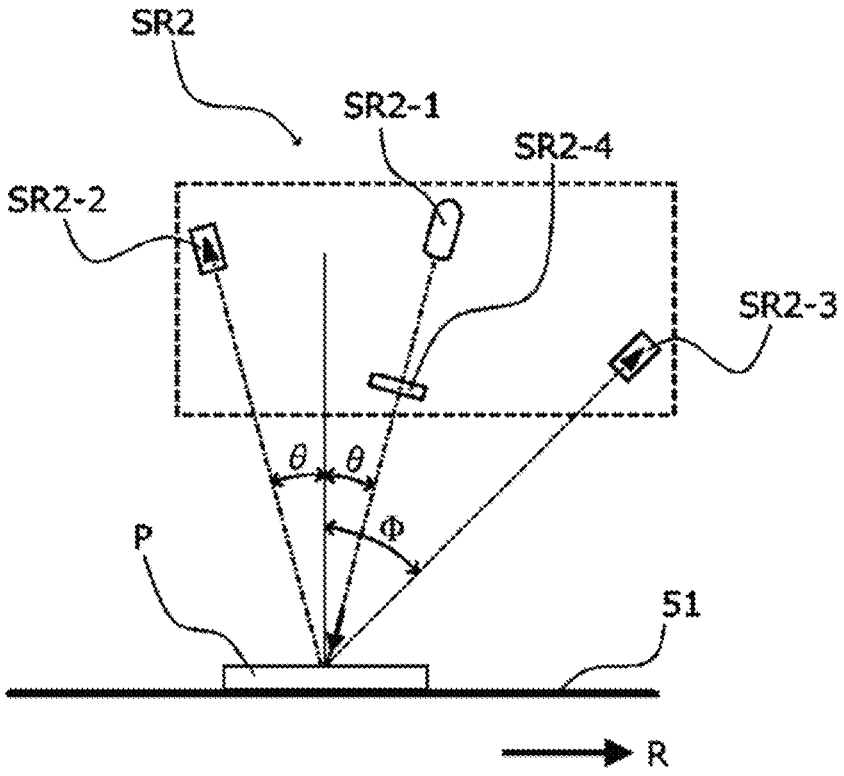
FIG. 3 is a diagram illustrating an example of an ADC sensor.
Figure 4A:
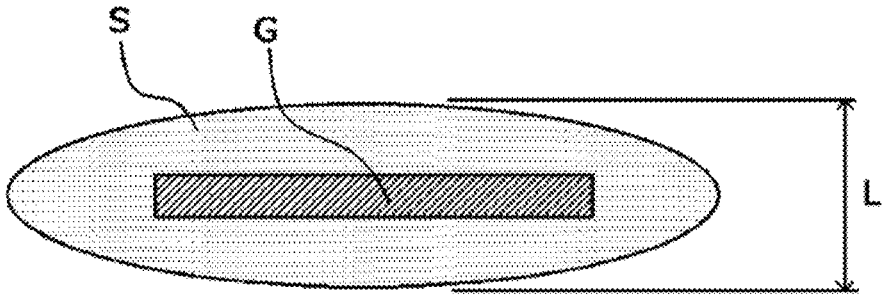
FIG. 4A and FIG. 4B are respectively a sectional view schematically illustrating a photoluminescent toner particle taken along a thickness direction and a schematic sectional view illustrating how the photoluminescent toner that has been fixed in place reflects light.
Figure 4B:
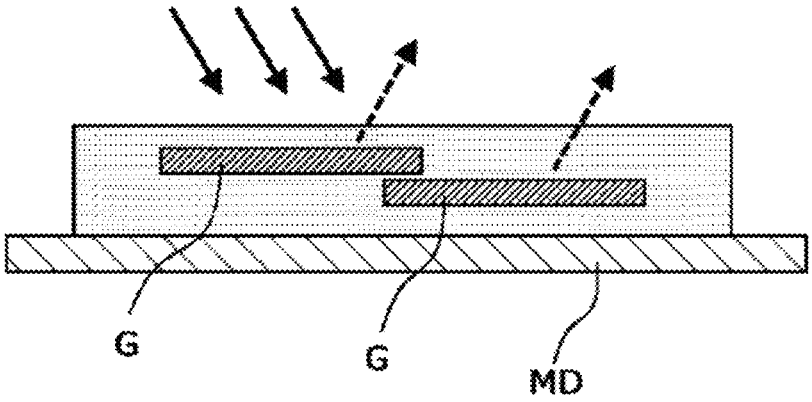
Figure 5A:
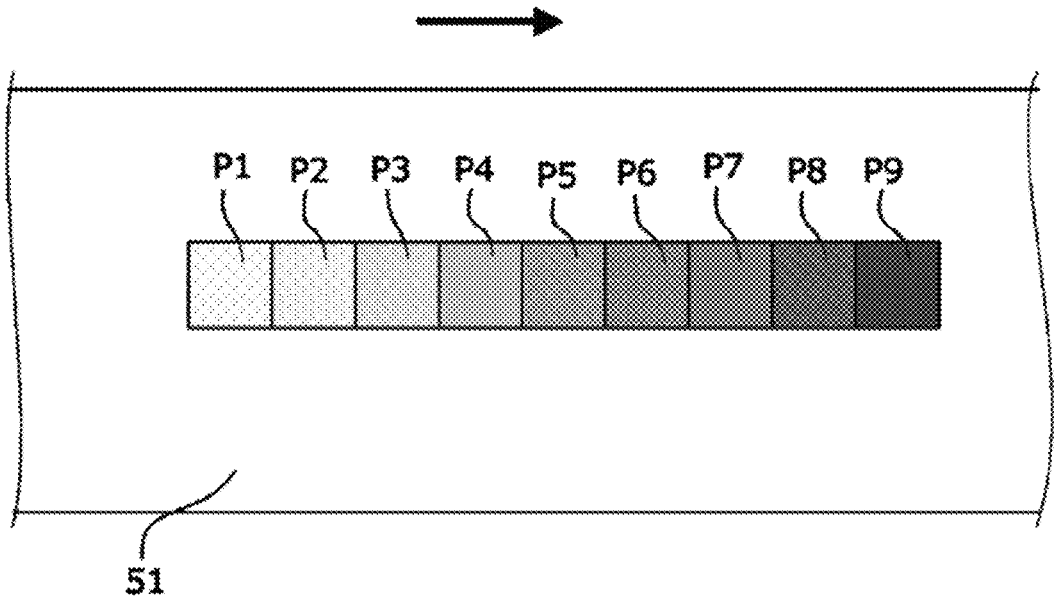
FIG. 5A and FIG. 5B are respectively a diagram illustrating toner patches formed on an intermediate transfer belt and a diagram illustrating reading of the toner patches.
Figure 5B:
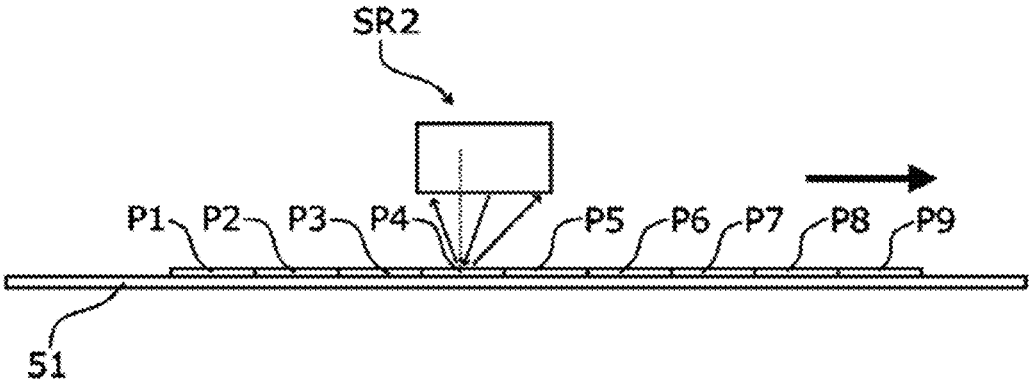
Figure 6:
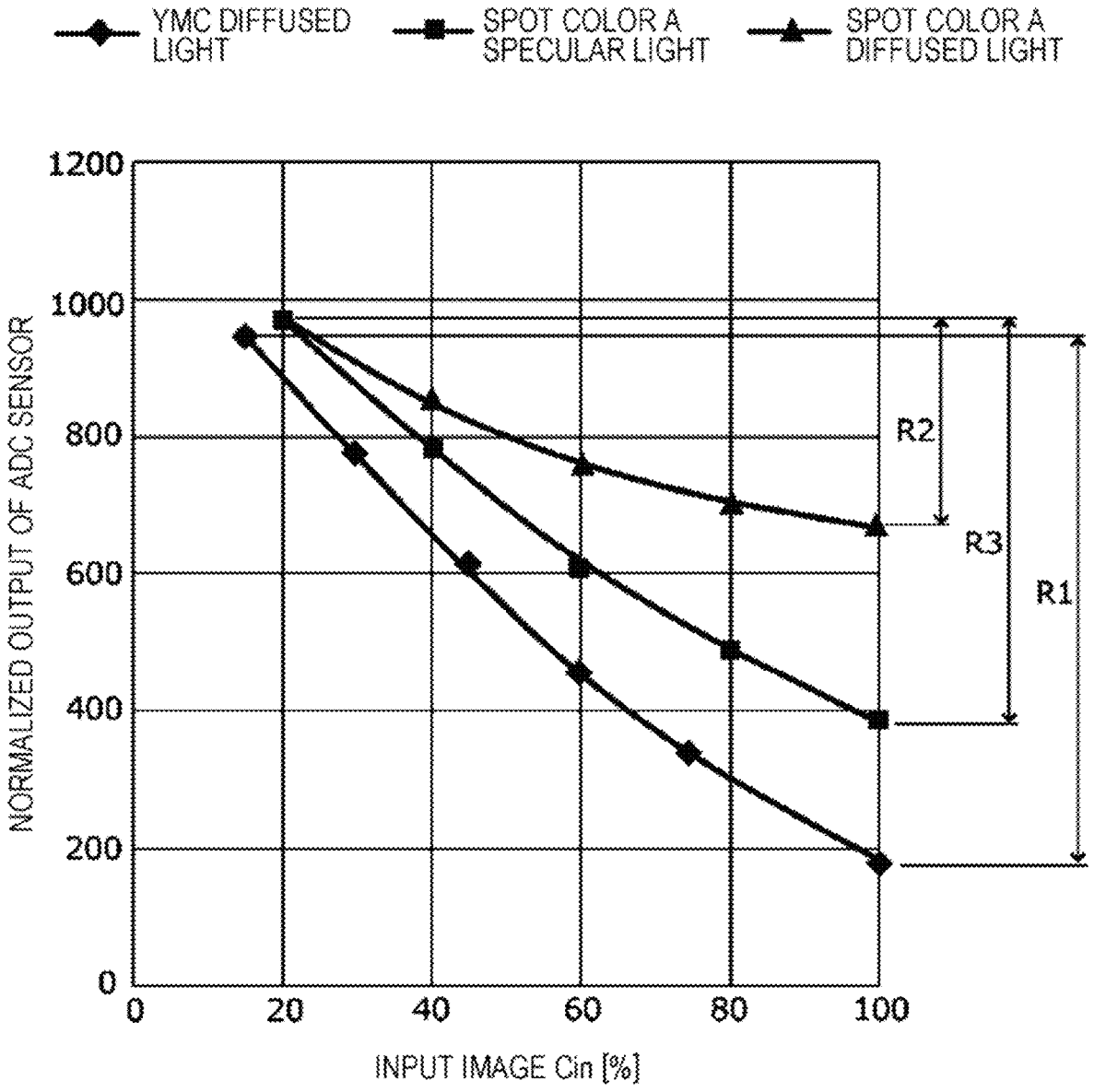
FIG. 6 is a graph illustrating an example of detection sensitivity of the ADC sensor.

FIG. 3 is a diagram illustrating an example of the ADC sensor SR2. FIG. 4A is a sectional view schematically illustrating one of photoluminescent toner particles S taken along a thickness direction, and FIG. 4B is a schematic sectional view illustrating how the photoluminescent toner that has been fixed in place reflects light. FIG. 5A is a diagram illustrating toner patches formed on the intermediate transfer belt 51, and FIG. 5B is a diagram illustrating reading of the toner patches. FIG. 6 is a graph illustrating an example of the detection sensitivity of the ADC sensor SR2.

Detection of the density of a reference toner image will be described below with reference to the drawings.

The ADC sensor SR2 is a sensor that optically reads the density of a toner patch P that is transported together with the intermediate transfer belt 51 in a transport direction of the intermediate transfer belt 51 that is indicated by arrow R in FIG. 3.

As illustrated in FIG. 3, the ADC sensor SR2 includes a light-emitting unit SR2-1, a first light-receiving unit SR2-2, a second light-receiving unit SR2-3, and an optical system SR2-4. The light-emitting unit SR2-1 emits light, and the first light-receiving unit SR2-2 receives specularly reflected light that is some of the light radiated onto the toner patch P by the light-emitting unit SR2-1 and that is reflected by the toner patch P. The second light-receiving unit SR2-3 receives diffusely reflected light that is reflected by the toner patch P.

The light-emitting unit SR2-1 radiates irradiation light toward the intermediate transfer belt 51. In this case, the angle at which the irradiation light is incident on the intermediate transfer belt 51 is θ. The light-emitting unit SR2-1 is, for example, a light emitting diode (LED).

The optical system SR2-4 is positioned between the light-emitting unit SR2-1 and the intermediate transfer belt 51 and receives the irradiation light so as to adjust a travelling direction of light included in the irradiation light.

The first light-receiving unit SR2-2 receives specularly reflected light that is the light radiated through the optical system SR2-4 and regularly reflected by the intermediate transfer belt 51 and detects the densities of images that are included in the toner patch P formed on the intermediate transfer belt 51, the images being formed of black toner and a toner of a spot color such as gold or silver containing a photoluminescent pigment. The specularly reflected light is regularly reflected light, and thus, as illustrated in FIG. 3, the angle at which the light is specularly reflected by the intermediate transfer belt 51 is θ, which is the same as the angle of incidence of the irradiation light.

The second light-receiving unit SR2-3 receives diffusely reflected light that is the light radiated through the optical system SR2-4 and diffusely reflected by the intermediate transfer belt 51 and detects the densities of images that are included in the toner patch P formed on the intermediate transfer belt 51, the images being formed of toners of general colors (Y, M, or C) excluding black and white toner. The angle at which the light is diffusely reflected by the intermediate transfer belt 51 is different from the above-mentioned angle of incidence θ and is, for example, Φ as illustrated in FIG. 3.

The first light-receiving unit SR2-2 and the second light-receiving unit SR2-3 are optical elements each of which generates a signal that corresponds to light received thereby and are, for example, photodiodes (PD).

The ADC sensor SR2 specifies the color of the toner patch P from the wavelengths of the reflected light beams received by the first light-receiving unit SR2-2 and the second light-receiving unit SR2-3 and outputs a value (a sensor value) that corresponds to the density of the toner patch P to the system control device 11 on the basis of the intensities of the received reflected light beams.

In the printing market, photoluminescent metallic printing has been performed by using photoluminescent toners containing metallic pigments. Metallic printing has been used for various applications such as greeting cards, book covers, labels, and packages because of its impressive and versatile expressiveness.

As schematically illustrated in FIG. 4A, a photoluminescent toner has the flat photoluminescent toner particles S each having an equivalent circle diameter longer than a thickness L thereof, and each of the particles S contains a scalelike metallic pigment G that is an example of a photoluminescent pigment. A photoluminescent toner such as gold or silver has particles each of which has a flat shape, so that particles of a photoluminescent pigment contained in the toner are oriented in parallel to the long-axis direction of the toner. Consequently, particles of a photoluminescent pigment contained in a toner transferred to a medium MD, which is a sheet, a film, or the like, become parallel to the medium MD, and as illustrated in FIG. 4B, the light reflectivity of the pigment in an image that has been fixed to the medium MD is improved. As a result, the image exhibits high brightness and obtains its metallic look.

As illustrated in FIG. 5A as an example, a reference toner image formed of such a type of toner is formed by forming a plurality of toner patches (patch patterns P[i], where "i" is 1 to 9) having different area gradation percentages Cin onto the intermediate transfer belt 51, and as illustrated in FIG. 5B, the ADC sensor SR2, which is disposed so as to face the intermediate transfer belt 51, reads the density of each of the toner patches that move with the intermediate transfer belt 51. Note that the toner patches may be formed in a continuous manner for each of the toner colors or may be formed independently of one another for each of the toner colors.

FIG. 6 illustrates an example of a normalized output value of the ADC sensor with respect to an input area gradation percentage Cin (%) of each of the toner patches P formed of various toners.

As illustrated in FIG. 6, in the cases of toners of general colors (Y, M, and C), when diffusely reflected light is received by the second light-receiving unit SR2-3 of the ADC sensor SR2, the output value of the ADC sensor with respect to the input area gradation percentages Cin (%) of the toner patches P may obtain wide sensitivity R1.

In contrast, in the case of a spot color A (silver toner), which is an example of a photoluminescent toner, when diffusely reflected light is detected, the output value of the ADC sensor with respect to the input area gradation percentages Cin (%) of the toner patches P only obtains narrow sensitivity R2. This is surmised to be because the photoluminescent toner has a large amount of specular reflection component since it contains the scalelike metallic pigment G as illustrated in FIG. 4A, and even if the amount of the toner is increased, the diffusion output value does not change as much as that in the case of each of the toners of general colors.

In the case of the spot color A (silver toner), which is an example of a photoluminescent toner, when specularly reflected light is detected, as denoted by sensitivity R3 in FIG. 6, the sensitivity R3 of the output value of the ADC sensor with respect to the input area gradation percentages Cin (%) of the toner patches P increases.

In the case of black toner, specularly reflected light decreases as the amount of the toner increases, and thus, high detection sensitivity may be obtained by detecting specularly reflected light.

As described above, specularly reflected light is detected for black toner and photoluminescent toner, and diffusely reflected light is detected for toners of general colors (Y, M, and C) and white toner, so that the detection sensitivity of the ADC sensor SR2 according to the type of toners may be kept high.

In the image forming apparatus 1 according to the present exemplary embodiment, one of a first detection method (hereinafter referred to as a "specular reflection method") for detecting the density of a reference toner image for density measurement, which is formed on the intermediate transfer belt 51, by receiving specularly reflected light reflected by the reference toner image and a second detection method (hereinafter referred to as a "diffuse reflection method") for detecting the density of the reference toner image by receiving diffusely reflected light from the intermediate transfer belt 51 and the reference toner image is selected, and the density of the reference toner image is optically detected.

(3) Detection of Density of Reference Toner Image in Setup Operation

Figure 7:
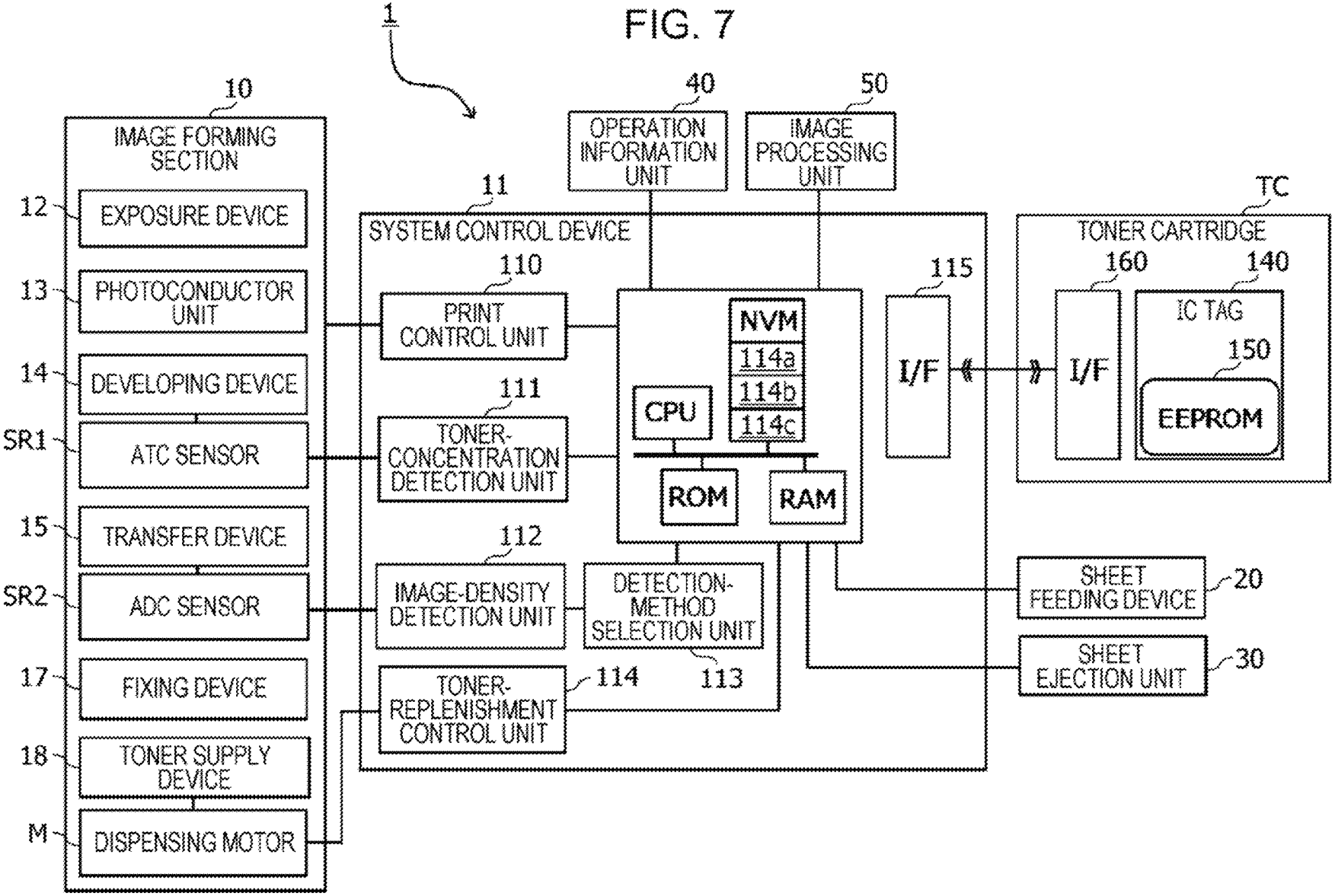
FIG. 7 is a functional block diagram illustrating a functional configuration of the image forming apparatus.

FIG. 7 is a functional block diagram illustrating a functional configuration of the image forming apparatus 1 according to the present exemplary embodiment.

As illustrated in FIG. 7, the system control device 11 includes a print control unit 110, a toner-concentration detection unit 111, an image-density detection unit 112, a detection-method selection unit 113, and a toner-replenishment control unit 114, and controls the operation of the image forming section 10 by running a control program stored in memory.

In addition, when one of the toner cartridges TC is installed in the body of the image forming apparatus 1, an interface 160 of the toner cartridge TC and an interface 115 of the system control device 11 are connected to each other, and the system control device 11 becomes capable of performing communication. In FIG. 7, although communication between the system control device 11 and the IC tag 140 is illustrated as wired communication, the communication may be wireless communication.

The IC tag 140, which is an example of a storage unit, is attached to each of the toner cartridges TC. Each of the IC tags 140 includes a non-volatile memory 150 such as an electrically erasable and programmable read only memory (EEPROM) and the interface 160.

When one of the toner cartridges TC is installed in the body of the image forming apparatus 1, the interface 160 of the toner cartridge TC and the interface 115 of the system control device 11 are connected to each other, and the system control device 11 becomes capable of performing communication. In FIG. 7, although communication between the system control device 11 and the IC tag 140 is illustrated as wired communication, the communication may be wireless communication.

Information stored in the IC tags 140 may be read and rewritten by a central processing unit (CPU) included in the system control device 11. The CPU is connected to random access memory (RAM), read only memory (ROM), a non-volatile memory (NVM), and the interface 115. The CPU reads a program for controlling the operation of the image forming apparatus 1 from the ROM and reads and rewrites information stored in the RAM and the nonvolatile memory (NVM).

The non-volatile memory (NVM) of the system control device 11 has a first region 114*c* in which information items that correspond to unique information items of the IC tags 140 are stored as well as a region 114*a* in which various setting information items for performing image formation are stored and a region 114*b* in which a serial ID of the body of the image forming apparatus 1 is stored.

The non-volatile memory 150 in each of the IC tags 140 has a reading region in which a unique information item read from the system control device 11 is stored and a reading and writing region used for storing management information that is read and written between the IC tag 140 and the system control device 11.

Figure 8:
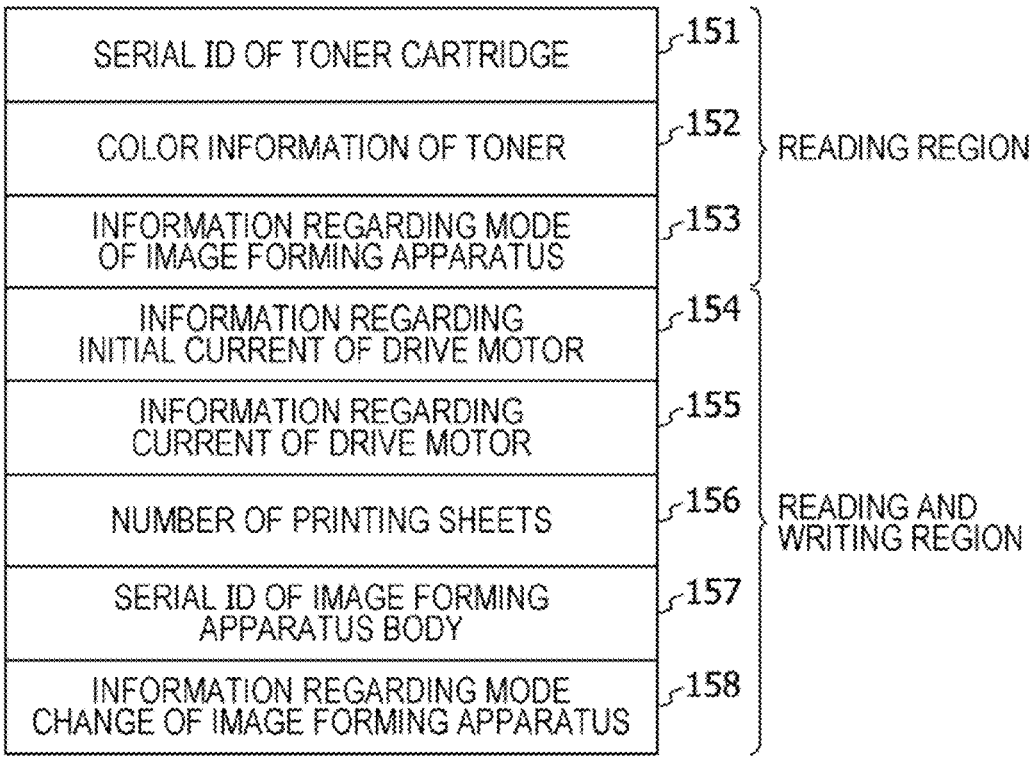
FIG. 8 is a block diagram of a storage region of an IC tag.

As functionally illustrated in FIG. 8, examples of the reading region include a region 151 in which serial IDs each of which is unique to one of the toner cartridges TC are stored, a region 152 in which color information items of the toners are stored, and a region 153 in which information regarding the mode of the image forming apparatus 1 is stored. Examples of the reading region may also include a region 154 in which information regarding an initial current of a drive motor is stored, a region 155 in which information regarding a current of a drive motor is stored, a region 156 in which a number of printing sheets is stored, a region 157 in which a serial ID of a body of the image forming apparatus 1 is stored, and a region 158 in which information regarding a mode change of the image forming apparatus 1 is stored.

The print control unit 110 performs control of transmission and reception of information among the sheet feeding device 20, the sheet ejection unit 30, the operation information unit 40, and the image processing unit 50 and also issues operational control instructions to the exposure devices 12, the photoconductor units 13, the developing devices 14, the transfer device 15, the sheet transport devices 16*a*, 16*b*, and 16*c* (not illustrated in FIG. 7, see FIG. 1), the fixing device 17, the toner supply devices 18, and so forth, which are included in the image forming section 10.

The toner-concentration detection unit 111 acquires information items regarding the toner concentrations in the developing devices 14 on the basis of detection results obtained by the ATC sensor SR1.

In order to stabilize image density and gradation, in a setup operation that is performed when, for example, the image forming apparatus 1 is switched on, when a job is started, during execution of a job, or when a job is ended, the image-density detection unit 112 reads the reference toner image (patch patterns P[i]) for density measurement formed on the intermediate transfer belt 51 by using the ADC sensor SR2 and acquires information regarding the density of the reference toner image.

When one of the toner cartridges TC or one of the image forming engines is installed, the detection-method selection unit 113 drives the corresponding developing device 14 and performs the setup operation for confirming an image-density detection method. Then, the detection-method selection unit 113 selects either "a specular detection method" or "a diffusion detection method" as the image-density detection method in accordance with the color information of the toner, the color information being stored beforehand in the IC tag 140 attached to the toner cartridge TC. More specifically, when the color information of the toner is one of general colors, which are Y, M, and C, or white, the "diffusion detection method" is selected, and when the color information of the toner is black or a photoluminescent color, such as gold or silver (hereinafter sometimes referred to as a "spot color"), the "specular detection method" is selected.

In the case where the color information of the toner is not stored beforehand in the IC tag 140, the detection-method selection unit 113 selects either the "specular detection method" or the "diffusion detection method" on the basis of the rate of change in the output signal of the ADC sensor SR2 that is obtained by performing the setup operation for driving the image forming engine when the toner cartridge TC or the image forming engine is installed.

The toner-replenishment control unit 114 adjusts the concentrations of the toners contained in the developers in the developing devices 14 by controlling the length of time over which dispensing motors M of the toner supply devices 18 rotate and the rotational speed of the dispensing motors M on the basis of toner-concentration detection values obtained by the ATC sensor SR1.

Figure 9:
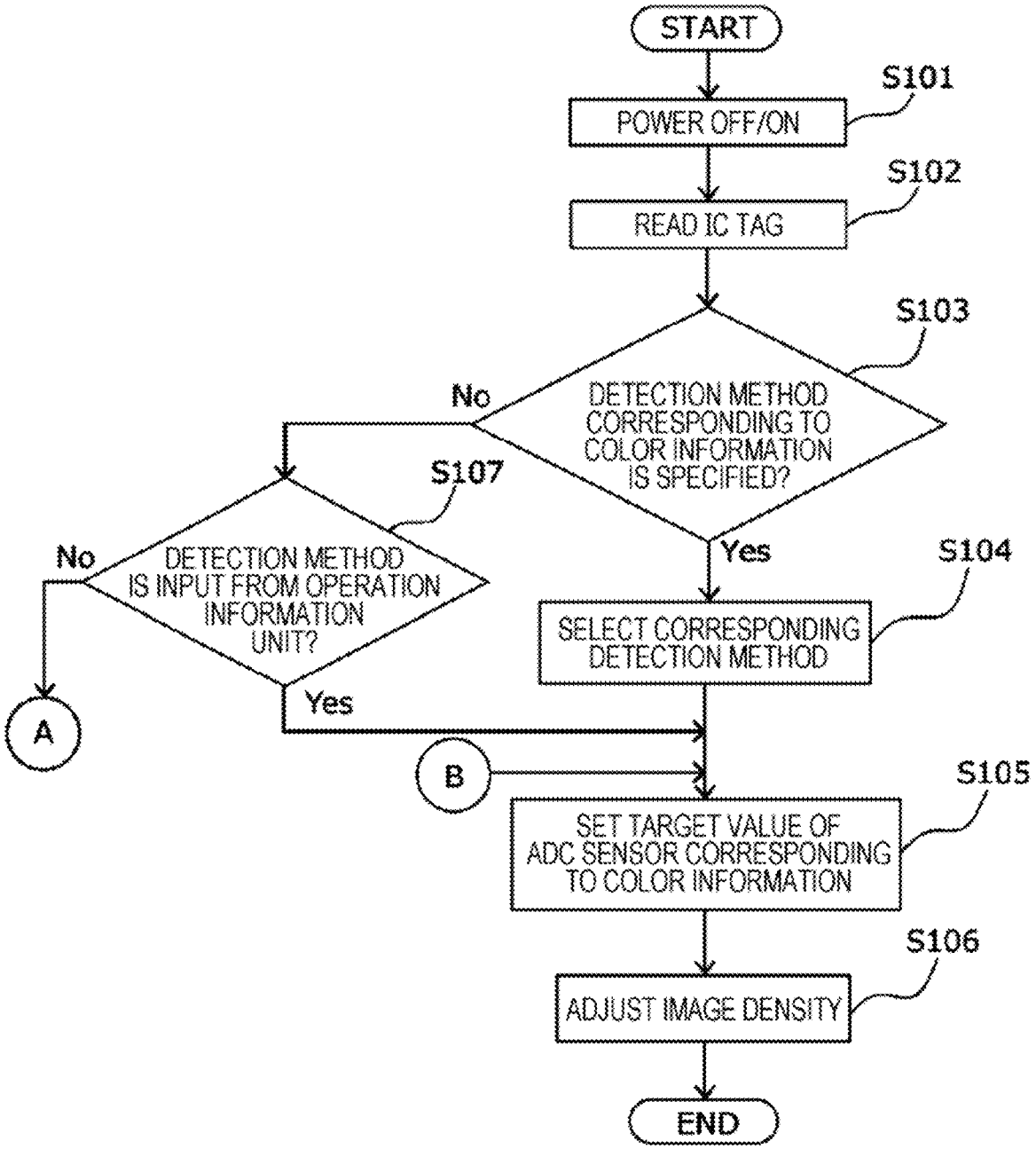
FIG. 9 is a flowchart illustrating a flow of processing for selecting a detection method, the processing being performed by a system control device when a toner cartridge or an image forming engine is installed.
Figure 10:
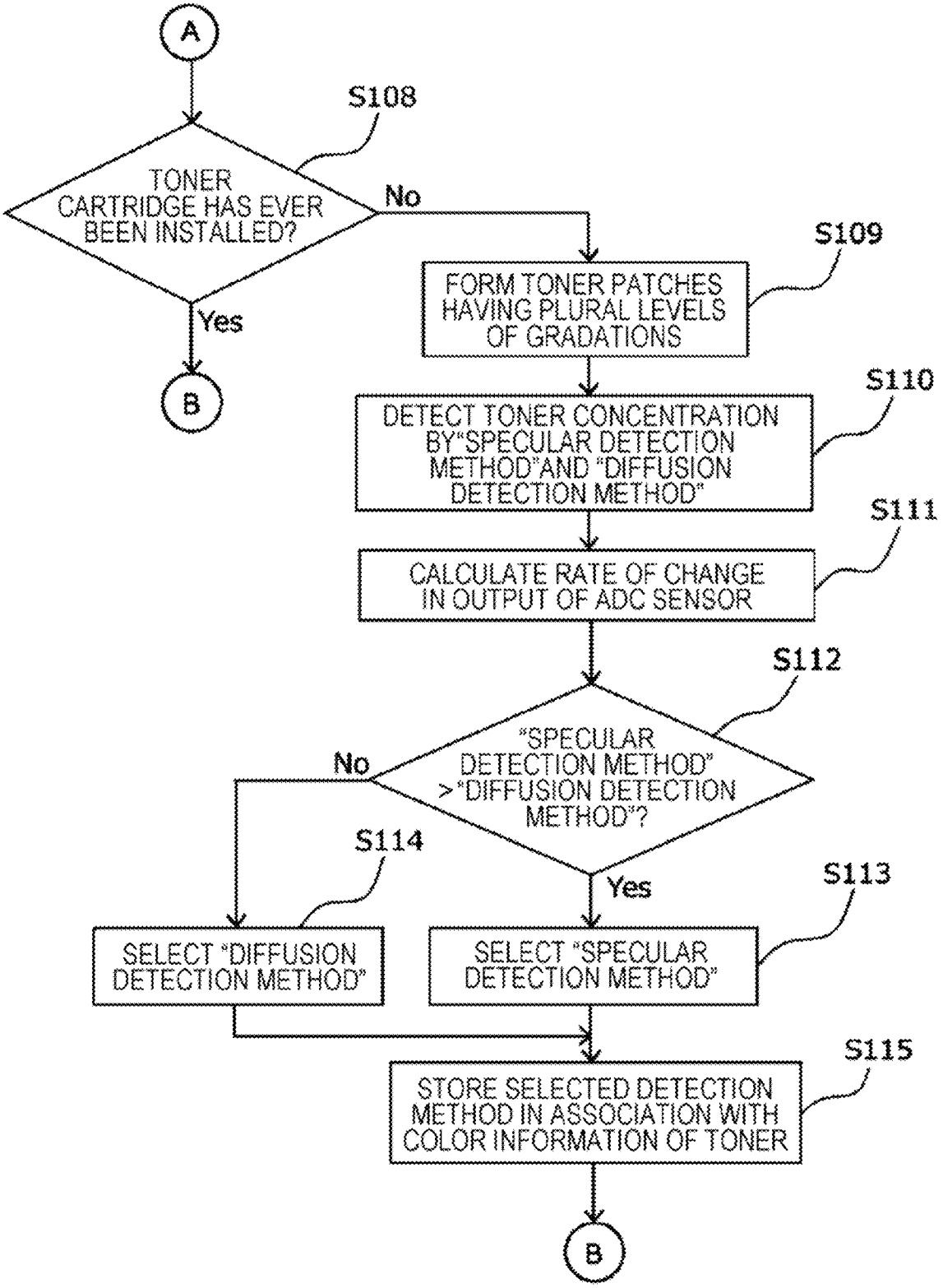
FIG. 10 is a flowchart illustrating a flow of processing for selecting a detection method, the processing being performed by the system control device when a toner cartridge or an image forming engine is installed.

FIG. 9 is a flowchart illustrating a flow of processing for selecting a detection method, the processing being performed by the system control device 11 when one of the toner cartridges TC or one of the image forming engines is installed.

When the image forming apparatus 1 is switched off or switched on (S101), identification information and usage history information of the toner that are stored in the IC tag 140 of the toner cartridge TC are read (S102). Then, in step S103, it is determined whether a detection method of the ADC sensor SR2 that corresponds to the color information of the toner is specified (S103).

If the detection method corresponding to the color information of the toner is specified in the system control device 11 (Yes in S103), the detection method (the "specular detection method" or the "diffusion detection method") that corresponds to the color information of the toner is selected (S104), and a gradation patch target value of the ADC sensor SR2 that corresponds to the color information of the toner is set (S105). Note that, in step S103, if the detection method (the "specular detection method" or the "diffusion detection method") is specified for the identification information of the toner stored in the IC tag 140, the detection method that is read may be selected.

Then, image density adjustment is performed by reading the density of each of the toner patches by the selected detection method, the toner patches being formed so as to have different area gradation percentages Cin (S106).

In step S103, if the detection method of the ADC sensor SR2 that corresponds to the color information of the toner is not specified (No in S103), it is determined whether a detection method is input from the operation information unit 40 (S107).

In the present exemplary embodiment, a user who uses the image forming apparatus 1 or an operator who performs maintenance of the image forming apparatus 1 is capable of selecting a detection method for each type of toner and starting the setup operation via the operation information unit 40, which is an example of an operation information unit that receives an operation performed by an operator.

If a detection method is input and selected by using the operation information unit 40 (Yes in S107), a gradation patch target value of the ADC sensor SR2 that corresponds to the color information of the toner is set (S105), and the image density adjustment is performed by reading the density of each of the toner patches, which are formed so as to have different area gradation percentages Cin, by the selected detection method (S106).

In step S107, if it is determined that a detection method is not input from the operation information unit 40 (No in S107), it is determined whether the toner cartridge TC has ever been installed (S108).

If the toner cartridge TC is installed for the first time (No in S108), the image forming engine is driven, and toner patches (patch patterns P[i]) having a plurality of levels of gradation (e.g., levels of gradation from Cin 0% to Cin 100%) are formed onto the intermediate transfer belt 51 (S109).

Then, image-density measurement is performed on the toner patches having a plurality of levels of gradation by using both the "specular detection method" and the "diffusion detection method" (S110), and the rate of change in (the sensitivity of) the output value of the ADC sensor in each of the detection methods is calculated (S111).

Figure 11:
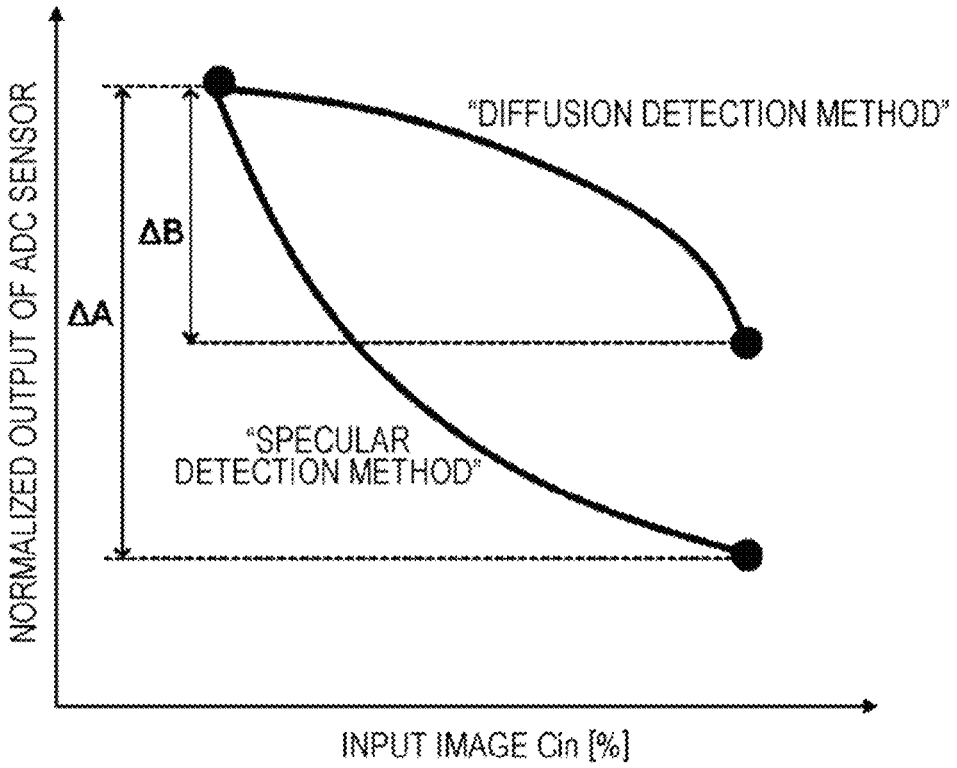
FIG. 11 is a diagram schematically illustrating rates of change in an output value of the ADC sensor.

FIG. 11 schematically illustrates rates of change in the output value of the ADC sensor in this case. In the case illustrated in FIG. 11, the rate of change in the output value of the ADC sensor in the case of detecting by using the "diffusion detection method" is AB, and the rate of change in the output value of the ADC sensor in the case of detecting by using the "specular detection method" is AA that is greater than the rate of change AB.

Subsequently, the rate of change in the output value of the ADC sensor in the case of detecting by using the "specular detection method" and the rate of change in the output value of the ADC sensor in the case of detecting by using the "diffusion detection method" are compared with each other (S112). If the rate of change AA in the output value of the ADC sensor in the case of detecting by using the "specular detection method" is greater (Yes in S112), the "specular detection method" is selected as the detection method (S113), and if the rate of change AB in the output value of the ADC sensor is greater (No in S112), the "diffusion detection method" is selected as the detection method (S114).

Figure 12:
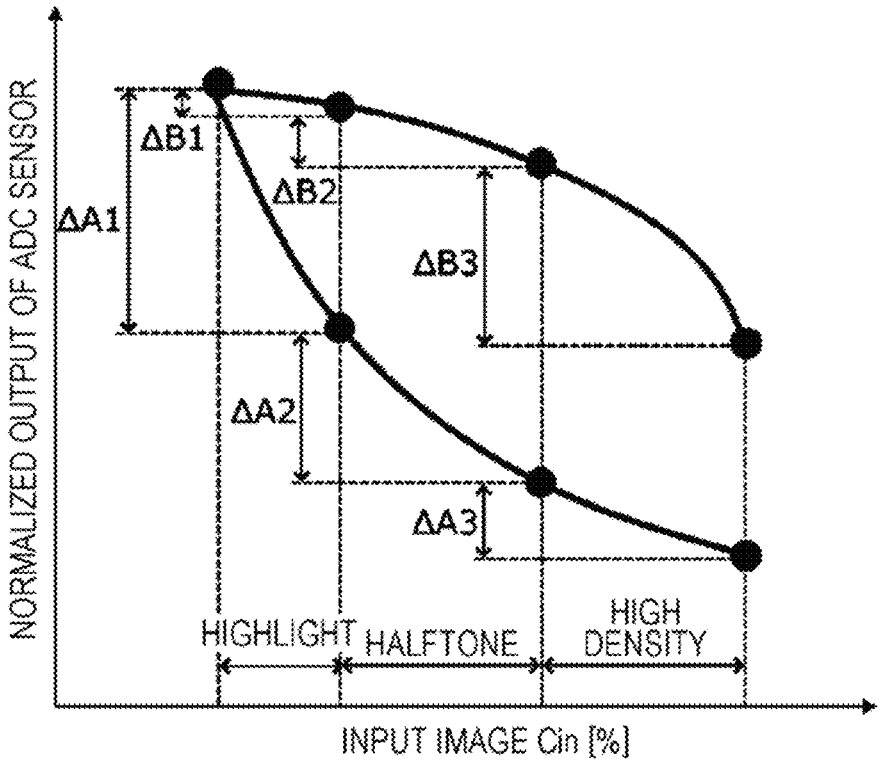
FIG. 12 is a diagram illustrating the case where rates of change in the output value of the ADC sensor are each divided into gradation regions, which are a highlight region, a halftone region, and a high-density region, and the rates of change in each detection method is calculated.

FIG. 12 illustrates the case where rates of change in the output value of the ADC sensor are each divided, in terms of Cin, into gradation regions that are a highlight region, a halftone region, and a high-density region, and the rates of change in each detection method are calculated.

In FIG. 12, the rates of change in the highlight region are ΔA1 and ΔB1, the rates of change in the halftone region are ΔA2 and ΔB2, and the rates of change in the high-density region are ΔA3 and ΔB3.

Such differences between the rates of change may be calculated from the rates of change in the entire range of input area gradation percentage, which is from Cin 0% to Cin 100%, as illustrated in FIG. 11, or may be calculated by, for example, selecting the rates of change in one of the gradation regions that has the highest priority for the toner color as illustrated in FIG. 12.

The detection method selected in the manner described above is stored in the non-volatile memory (NVM) of the system control device 11 in association with the color information of the toner (S115).

Such processing for selecting either the "specular detection method" or the "diffusion detection method" as an image-density detection method in accordance with the color information of a toner may be applied not only to the case where engine installation positions of image forming engines that correspond to toners of spot colors such as gold and silver are changed but also to the case where engine installation positions of image forming engines that correspond to toners of Y, M, C, and K, which are general colors, are changed.

The image forming apparatus 1 according to the present exemplary embodiment has the image-density detection methods, which are the "specular detection method" and the "diffusion detection method", for toners having different characteristics and selects either the "specular detection method" or the "diffusion detection method" as the image-density detection method in accordance with the color information of a toner, the color information being stored beforehand in a toner cartridge that is installed. Even when the positions of image forming engines are exchanged, the image-density detection method is selected in accordance with the color information of a toner.

Even in the case where a detection method that corresponds to information of a toner is not specified, the setup operation is performed when one of the toner cartridges TC is installed, and the detection method that is suitable for the type of a toner is selected on the basis of the difference in the rates of change in the output value of the ADC sensor.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a detection unit configured to optically detect a density of a reference toner image for density measurement formed on an image carrier, wherein the detection unit is configured to select either a first detection method or a second detection method using color information of a toner, wherein the color information is stored beforehand in a storage unit, wherein the first detection method comprises receiving specularly reflected light reflected by the image carrier and the reference toner image, wherein the second detection method comprises receiving diffusely reflected light from the image carrier and the reference toner image, wherein the detection unit is configured to optically detect the density of the reference toner image by using the selected one of the first detection method and the second detection method, and wherein the detection unit is configured to, if the color information of the toner is not stored beforehand in the storage unit, and if at least one of image forming engines is installed, then select one of the first detection method and the second detection method by which a larger rate of change in a detected value is obtained, the detected value being obtained by optically detecting the density of the reference toner image that has a plurality of levels of gradation, by performing a setup operation for driving the at least one of image forming engines, and optically detect the density of the reference toner image.

2. The image forming apparatus according to claim 1, wherein a plurality of image forming engines are arranged, wherein each of the image forming engines are configured to form a toner image, and wherein the detection unit is configured to optically detect a density of the reference toner image using the color information of the toner stored beforehand in the storage unit even if arrangement positions of the image forming engines are exchanged.

3. The image forming apparatus according to claim 2, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

4. The image forming apparatus according to claim 2, wherein the detection unit comprises:

a first light-emitting element configured to radiate specularly reflected light onto the reference toner image for density measurement formed on the image carrier;

a second light-emitting element configured to radiate diffusely reflected light onto the reference toner image for density measurement formed on the image carrier; and a light-receiving element configured to receive light reflected by the image carrier and the reference toner image.

5. The image forming apparatus according to claim 1, wherein the detection unit is configured to, if at least one of image forming engines is installed, then select either the first detection method or the second detection method by performing a setup operation for driving the at least one of image forming engines.

6. The image forming apparatus according to claim 5, wherein the detection unit is configured such that the setup operation is performed if a user who uses the image forming apparatus or an operator who performs maintenance on the image forming apparatus performs an adjustment operation via an operation information unit configured to receive an operation that is performed on the image forming apparatus.

7. The image forming apparatus according to claim 6, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

8. The image forming apparatus according to claim 6, wherein the detection unit comprises:

a first light-emitting element configured to radiate specularly reflected light onto the reference toner image for density measurement formed on the image carrier;

a second light-emitting element configured to radiate diffusely reflected light onto the reference toner image for density measurement formed on the image carrier; and a light-receiving element configured to receive light reflected by the image carrier and the reference toner image.

9. The image forming apparatus according to claim 5, wherein the detection unit is configured such that, if the at least one of the image forming engines is installed, then the setup operation is performed using the color information of the toner stored beforehand in the storage unit.

10. The image forming apparatus according to claim 9, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

11. The image forming apparatus according to claim 9, wherein the detection unit comprises:

a first light-emitting element configured to radiate specularly reflected light onto the reference toner image for density measurement formed on the image carrier;

a second light-emitting element configured to radiate diffusely reflected light onto the reference toner image for density measurement formed on the image carrier; and a light-receiving element configured to receive light reflected by the image carrier and the reference toner image.

12. The image forming apparatus according to claim 5, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

13. The image forming apparatus according to claim 5, wherein the detection unit comprises:

a first light-emitting element configured to radiate specularly reflected light onto the reference toner image for density measurement formed on the image carrier;

a second light-emitting element configured to radiate diffusely reflected light onto the reference toner image for density measurement formed on the image carrier; and a light-receiving element configured to receive light reflected by the image carrier and the reference toner image.

14. The image forming apparatus according to claim 1, wherein the first detection method or the second detection method that is selected is stored in association with the color information of the toner.

15. The image forming apparatus according to claim 14, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

16. The image forming apparatus according to claim 1, wherein the detection unit comprises:

a light-emitting element configured to radiate light onto the reference toner image for density measurement formed on the image carrier;

a first light-receiving element configured to receive specularly reflected light reflected by the image carrier and the reference toner image; and a second light-receiving element configured to receive diffusely reflected light reflected by the image carrier and the reference toner image.

17. The image forming apparatus according to claim 1, wherein the detection unit comprises:

a first light-emitting element configured to radiate specularly reflected light onto the reference toner image for density measurement formed on the image carrier;

a second light-emitting element configured to radiate diffusely reflected light onto the reference toner image for density measurement formed on the image carrier; and a light-receiving element configured to receive light reflected by the image carrier and the reference toner image.

18. The image forming apparatus according to claim 1, wherein the color information of the toner includes color information of a spot color toner that has metallic luster.

19. The image forming apparatus according to claim 1, wherein the detection unit is configured to select the first detection method in response to determining that the stored color information indicates that the toner is a photoluminescent toner.

20. The image forming apparatus according to claim 19, wherein the detection unit is configured to select the second detection method in response to determining that the stored color information indicates that the toner is a toner of a general color other than a photoluminescent toner or a black toner.

21. The image forming apparatus according to claim 20, wherein the detection unit is configured to select the first detection method, and refrain from using the second detection method, in response to determining that the stored color information indicates that the toner is the photoluminescent toner.

22. The image forming apparatus according to claim 21, wherein the detection unit is configured to select the second detection method, and refrain from using the first detection method, in response to determining that the stored color information indicates that the toner is the toner of the general color.

23. An image forming apparatus comprising:

at least one processor configured to optically detect a density of a reference toner image for density measurement formed on an image carrier;

wherein the at least one processor is configured to select either a first detection method or a second detection method using color information of a toner, wherein the color information is stored beforehand in a storage, wherein the first detection method comprises receiving specularly reflected light reflected by the image carrier and the reference toner image, wherein the second detection method comprises receiving diffusely reflected light from the image carrier and the reference toner image, wherein the at least one processor is configured to optically detect the density of the reference toner image by using the selected one of the first detection method and the second detection method, and wherein the at least one processor is configured to, if the color information of the toner is not stored beforehand in the storage, and if at least one of image forming engines is installed, then select one of the first detection method and the second detection method by which a larger rate of change in a detected value is obtained, the detected value being obtained by optically detecting the density of the reference toner image that has a plurality of levels of gradation, by performing a setup operation for driving the at least one of image forming engines, and optically detect the density of the reference toner image.

* * * * *